United States Patent [19]

McFarlan

[11] Patent Number: 4,559,788

[45] **Date of Patent: * Dec. 24, 1985**

[54] AIR CONDITIONING SYSTEM AND METHOD

[76] Inventor: Alden I. McFarlan, 691 Dorian Rd., Westfield, N.J. 07090

[ * ] Notice: The portion of the term of this patent subsequent to Nov. 8, 2000 has been disclaimed.

[21] Appl. No.: 535,658

[22] Filed: Sep. 26, 1983

Related U.S. Application Data

[63] Continuation-in-part of Ser. No. 301,655, Sep. 18, 1981, Pat. No. 4,419,864, and a continuation-in-part of Ser. No. 340,328, Jan. 18, 1982, Pat. No. 4,413,478.

[51] Int. Cl.[4] ..... F25D 17/02

[52] U.S. Cl. ..... 62/98; 62/159; 62/238.6; 62/325; 62/412; 62/435; 237/2 B

[58] Field of Search ..... 62/159, 98, 238.6, 412, 62/325, 435; 237/2 B

[56] References Cited

U.S. PATENT DOCUMENTS

| | | | |
|---|---|---|---|
| 2,797,068 | 6/1957 | McFarlan | 62/159 X |
| 2,928,260 | 3/1960 | Blum | 62/159 X |
| 3,127,929 | 4/1964 | Ringquist | 62/159 X |
| 3,513,663 | 5/1970 | Martin, Jr. et al. | 62/159 |
| 4,165,619 | 8/1979 | Girard | 62/159 X |
| 4,244,193 | 1/1981 | Haakenson | 62/412 X |
| 4,363,218 | 12/1982 | Nussbaum | 237/2 B X |
| 4,389,857 | 6/1983 | Svendsen | 62/412 X |
| 4,413,478 | 11/1983 | McFarlan | 62/159 X |

*Primary Examiner*—Lloyd L. King

*Attorney, Agent, or Firm*—Harold L. Stults

[57] ABSTRACT

An air conditioning system and method wherein a central pumping system circulates a heat-exchange liquid, through heating and cooling paths of a refrigeration system to and from air-treating units, and to and from a fluid cooler which acts as a heat sink and also as a heat source. The air-treating units have fans or blowers positioned upstream of the air cooling coils so that the fan heat is discharged through the fluid cooler system during cooling load operation, and that heat is available in the air-treating units during heating-load operation. One embodiment includes a separate line for supplying neutral water to each air-treating unit. The neutral water is mixed with either the hot water or the cold water supplied to each treating unit for temperature control. Another embodiment has only hot and cold water with separate supply and return lines. The systems may also be designed and operated to utilize the heat pump principle to raise the temperature of the heat-exchange liquid flowing to the fluid cooler above the generally accepted level. The fluid cooler discharges heat during dominant cooling load conditions through air which is exhausted from the conditioned space. The condensate from the air-treating units is supplied to the fluid cooler and provides evaporative cooling. The fluid cooler is also a heat source during dominant heating load conditions, with the exhaust air and some outside air being the fluid. The invention contemplates that water from an outside source can be used as the "fluid" as the source of heat and as the heat sink.

17 Claims, 2 Drawing Figures

AIR CONDITIONING SYSTEM AND METHOD

Figure 1:
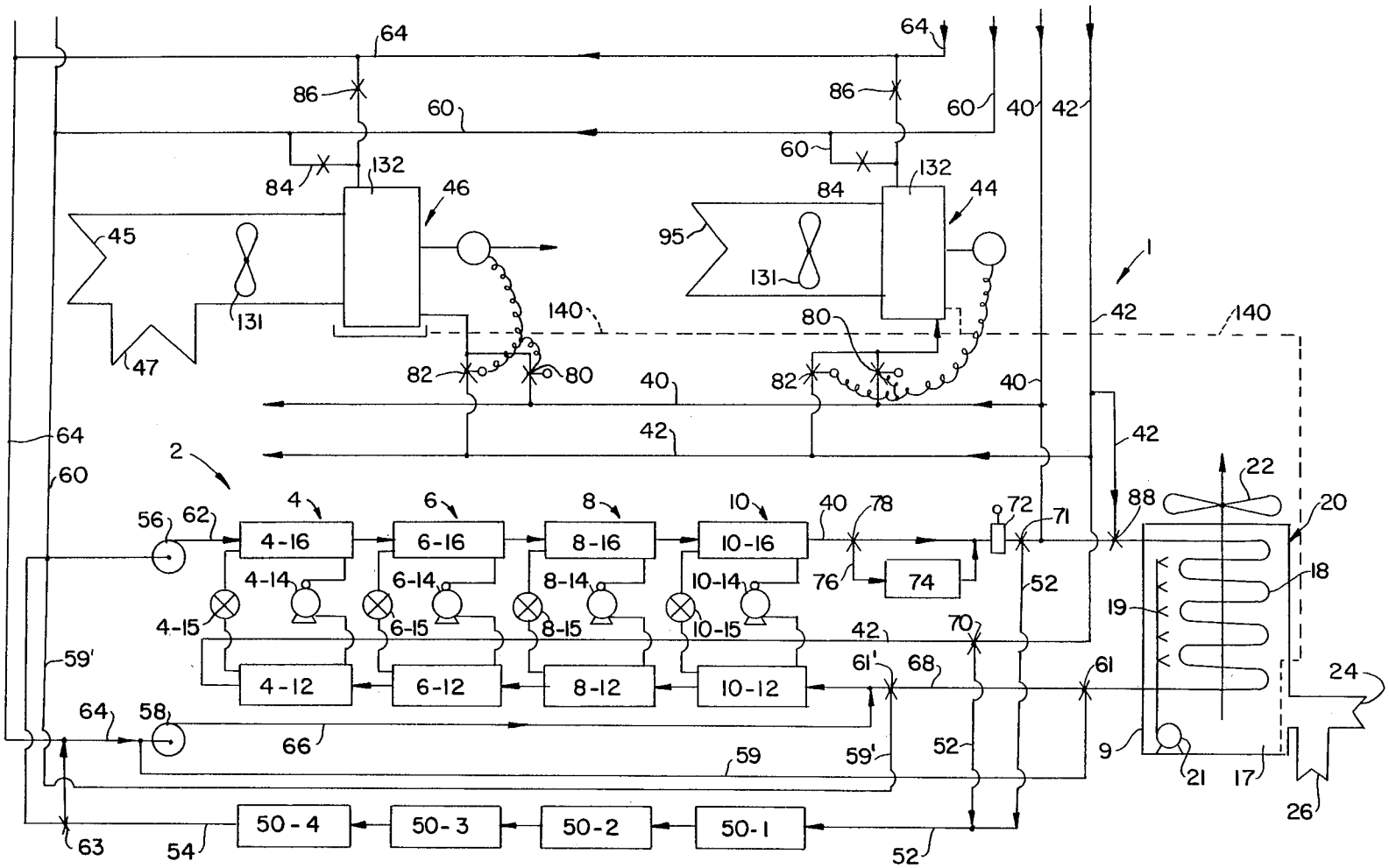

This application is a continuation-in-part of applications, Ser. No. 06/301,655, filed Sept. 18, 1981, now U.S. Pat. No. 4,419,864 and Ser. No. 06/340,328, filed Jan. 18, 1982, now U.S. Pat. No. 4,413,478.

This invention relates to improved air-conditioning systems in which separate streams of water or other heat-exchange liquid are pumped to air-treating units for the various air conditioned spaces. Systems of that type are disclosed in U.S. Pat. Nos. 3,850,007 and 4,010,624, which will be discussed below.

The present invention provides for greatly improved efficiencies of air conditioning systems with wider ranges of operation. Systems of the present invention have fluid coolers which provide "heat-sinks" through which the heat removed from the air conditioned space is discharged from the system to ambient air or water. When ambient air is the "heat-sink" fluid for prior air conditioning systems it is common practice to spray water on heat exchange coils to produce evaporative cooling. The present invention utilizes the fluid cooler to perform its "heat-sink" functions in an improved manner, and the fluid cooler also performs additional functions including acting as a means of heat removal when that is required by the system rather than passing the heat through a liquid cooler. Heat is transferred throughout the system and to and from a fluid cooler by a heat-exchange liquid which is called "water", but which may be pure water or a glycol solution or another liquid.

The above-mentioned U.S. Pat. Nos. 3,850,007 and 4,010,624, disclose air conditioning systems having a plurality of fluid coolers, i.e., cooling towers for cooling condenser water or tower condensers. In each of those systems, one tower provides cooling by air without evaporation of water, and another tower utilizes the condensate from the air conditioning system as the water which is evaporated to provide evaporative cooling. It is considered good practice from an engineering standpoint to provide outside air in air conditioning systems upon the basis of at least 1/10 cubic foot of air per minute for each square foot of are being cooled, and the remainder of the air is recirculated. With a view of conserving energy, it is also considered necessary to maintain the amount of outside air at the lowest level which will provide acceptable conditions within the air conditioned space. That has resulted in maintaining the various operating conditions of air conditioning systems within certain predetermined ranges. The systems disclosed in the above-identified patents operate generally within the accepted ranges of various conditions, but can operate with more outside air than is used with the present invention without penalizing the overall energy consumption. Each of those systems utilizes the condensate from the air conditioning system to cool at least one of the fluid coolers, i.e., a cooling tower or an evaporative condenser water cooler. Streams of heat-exchange liquid, such as water, flow through continuous circuits some of which carry the heat from the air-treating units which dehumidify and cool the air, to the evaporator-chillers of the refrigeration units, and another of which carries the heat from the condensers of the refrigeration units to the fluid coolers. A stream of heat-exchange liquid flows through the evaporator-chillers of a series of refrigeration units with its temperature being reduced in steps by the various evaporator-chillers. The flow through the condensers to the respective refrigeration units is counter to the flow through the evaporator-chillers of the respective refrigeration units.

The specific illustrative embodiments of the present invention are systems similar to those disclosed in the above-identified patents. However, in those embodiments, one fluid cooler is provided, and all of the condensate and the exhaust air available from the system are used to provide evaporative cooling for the fluid cooler. When the system is cooling the air conditioned space, the temperature of the water or other heat-exchange liquid passed to the fluid cooler is at a higher temperature than in the systems of the above-identified patents, and at a much higher temperature than the normally accepted practice. Also, the temperature drop of the heat exchange fluid is much greater than is normally provided in the fluid coolers or cooling towers of such air conditioning systems.

The present invention contemplates supplying outside air to the air-treating units in an amount relative to the total amount of air supplied to the air conditioned space which is within the range of 100% outside air to 1/10 cubic foot per square foot of air conditioned space, with recirculated air being added only as the remainder when desirable. It is accepted practice to maintain the air pressure within an air conditioned space at a value slightly above the outside air pressure so that there is leakage from the air conditioned space and air is exhausted automatically from toilets, kitchens, chemical laboratories, etc. Otherwise the amount of exhaust air is the same as the amount of outside air which is added to the system. In accordance with one aspect of the present invention, the amount of exhaust air which passes through the fluid cooler must be sufficient to discharge the amount of heat required to provide proper operation of the system. That is contrary to the generally accepted practice by which it has been considered desirable to use a much lower percentage of outside air than is utilized with the present invention, without penalizing energy consumption.

Figure 2:
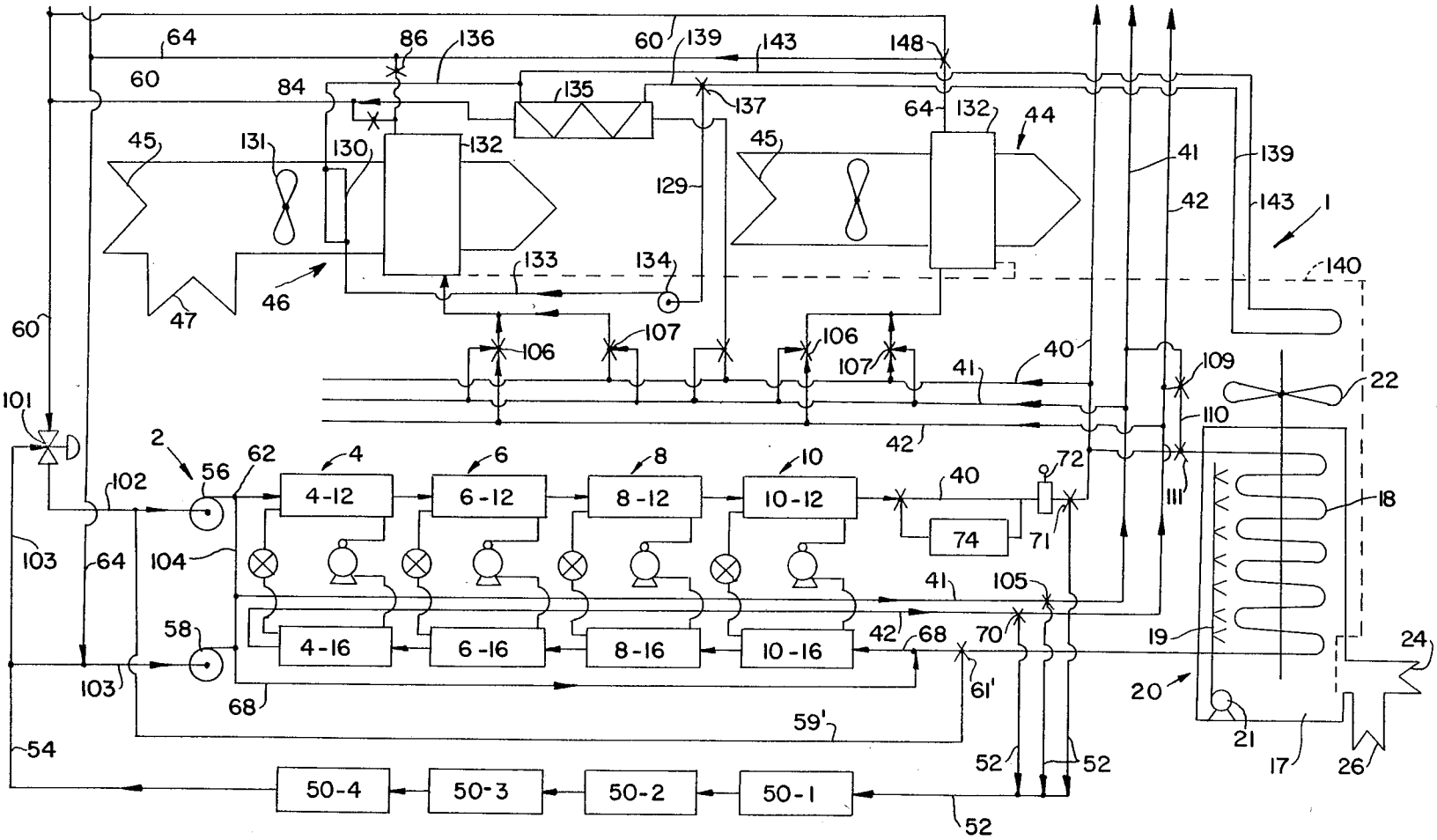

Referring to the drawings:

FIG. 1 is a schematic representation of a four-pipe air conditioning system which comprises one illustrative embodiment of the invention: and, FIG. 2 is similar to FIG. 1 but is of a three-pipe embodiment of the invention.

Referring to FIG. 1 of the drawings, an air-conditioning system 1 has a central refrigeration system 2 with four refrigeration units 4, 6, 8 and 10. Each of the refrigeration units has the following identical components of known types which are identified by the component number with a suffix number corresponding to the number of the refrigeration unit: A water-cooling evaporator-chiller or water cooler 12; a compressor 14; a water-cooled condenser 16; and, an expansion valve 15. There are also other standard control and operating components which are not shown. The water cooling circuits of the evaporator-chillers are connected in series flow to form the staged water-cooling circuit. The water heating circuits of the condensers are connected in series flow to form the staged water-heating circuit.

The system has a single fluid cooler 20 with the following components: A finned air-to-water heat exchange coil 18; a sump pan 17; a sprayer means 19 with a pump 21 which circulates water from pan 17 over coil 18; a blower 22 which forces air upwardly through the coil; and, an air supply damper assembly which supplies air to the fluid cooler with air being exhausted from the air conditioned space at 24 and ambient (outside) air being supplied at 26 in the manner more fully explained below.

Air conditioning system 1 has an air-treating unit 44 which is one of a number of similarly functioning units which supply conditioned air to the periphery of the building, and an air-treating unit 46 which is one of a number of similarly functioning units which supply air to the interior of the building. Hot and cold water is supplied to the air-treating units, respectively through separate hot water supply line 40 and its branches and cold water supply line 42 and its branches, and each unit is connected to separate hot water and cold water return lines 60 and 64, respectively. Each of air-treating units 46 is supplied with a stream of return air at 45 and a predetermined percentage of outside air at 47. Each of the air treating units has a "single pass" coil (not shown) in which the water flows from right to left in a continuous path in counter-flow relationship to the left to right flow of the stream of air which is being heated or cooled. That provides maximum heat transfer between the streams of air and water so that the air leaves the unit at a temperature which is near that of the entering water. The system has a storage tank circuit with four water retention or storage tanks 50 connected (and numbered 1 to 4) in series flow relationship between a supply line 52 and a discharge line 54. Line 52 is connected through normally closed valves 70 and 71, respectively to cold water line 42 and hot water line 40 so that either hot water or cold water can be supplied to the tanks.

Two pumps 56 and 58 constitute the water-pumping means which circulates the water throughout the entire air conditioning system. Pumps 56 and 58 receive water respectively through a hot water return line 60 and a cold water return line 64, and the branches of each of which extend from each of the air-treating units 44 and 46. Pump 58 can also receive water from tanks 50 through a line 54 having a valve 63 therein. Pump 58 can also receive water from coil 18 of the fluid cooler through a line 59 which is connected by a diverting valve 61 in the discharge line 68 from coil 18. Pump 56 can also receive water from coil 18 through a 30 diverting valve 61' in line 68 and a line 59', and also from line 54 through a valve 63 to line 64. Pump 56 discharges water through a line 62 which leads only to the staged water-heating circuit of the condensers in series thence to the hot water line 40. Pump 58 discharges water through a line 66 and line 68 to water-cooling circuit of the evaporator-chillers in series and to the cold water line 42. It should be noted that the flow through the condensers is counter to the flow through the evaporator-chillers of the respective refrigeration units. That provides substantial advantages from the combination of the staged cooling by the water-cooling circuit and the counterflow staged heating by the water-heating circuit.

Valves 70 and 71 may be opened to connect the cold water line 42 or the hot water line 40 to line 52 so as to permit either cold or hot water to be delivered to the series flow circuit of tanks 50. Line 54 is also connected through a normally closed valve 63 to line 60 so that water from tanks 50 can be delivered to pump 56. Valves 70, 71 and 63 provide great flexibility in operating, for example, to permit the off-peak recirculation of water from and back to tanks 50 to deliver heat to or extract heat from the water in the tanks during off-peak cooling-load heating-load conditions at night and thereby provide a "flywheel" effect to assist in handling an excessive heating or cooling loads during the daytime. A boiler 74 is connected in a line 76 which extends parallel to line 40, and diverting valve 78 is operative to pass water through the boiler when auxiliary heat is required. A heat-balance controller 72 senses the temperature of the water in line 42 downstream of the boiler circuit and restricts the flow through the condenser to increase the water temperature, and when desirable operates valve 78. However, the facility for recirculating water from the tanks through the water-cooling and water-heating circuits and back to the tanks is of substantial benefit under extreme heating and cooling load conditions because it is possible to remove heat from or deliver heat to the water in the tanks and thereby increase the heating and cooling capacity of the system. That and other features of the system reduce the need to use the boiler. Heat balance controller 72 also senses the temperatures outside and within the system, and exerts overall control over the entire air conditioning system and responds to the temperatures and heating and cooling load conditions through the air conditioned space. When desirable, the heat balance controller restricts the flow rate through the condenser circuit so as to increase the temperature of the water. Except as specified and discussed below, the control circuit, including the sensing and control components and the modes of operation, are in accordance with the prior U.S. Pat. No. 3,738,899.

Each of air-treating units 44 and 46 is connected to hot and cold water supply lines 40 and 42, respectively, by valves 80 and 82 which are thermostatically controlled in response to the temperature of the air discharged by the unit. Each of units 44 and 46 is thereby connected to receive either hot or cold water, but not a mixture of the two, to maintain the desired air temperature in the conditioned spaces. Valves 84 and 86 connect each of units 44 and 46 to the hot and cold water return lines 60 and 64, respectively. Valve 80 and 84 for each unit 44 and 46 are opened and closed together, and valves 82 and 86 are opened and closed together, so that the hot water from line 40 is returned to pump 56 and the cold water from line 42 is returned to pump 58. A modulating valve 88 connects both the hot water line 40 and the cold water line 42 to coil 18 of the fluid cooler. Modulating valve 88 is normally in the position in which it supplies only hot water to coil 18 of the fluid cooler. However, there are times when valve 88 supplies a controlled stream of cold water to coil 18, for example, below the heat-balance temperature when the fluid cooler is being used as a source of the heat required to balance the net loss with a heat pump action extracting heat from the exhaust air. The outside air dampers can then be closed so that only exhaust air passes through the fluid cooler, and cold water is supplied to coil 18. Valve 61 is then positioned to pass the water from coil 18 through line 59 to pump 58 and through the water-cooling circuit. Water returning through line 64 also passes from pump 58 through the evaporator-chiller circuit. As explained above, the chilled water may be passed to the tank circuit and the water in the tank is passed to pump 56 and through the water-heating circuit. Those operations raise the temperature level of the hot water so that the heat extracted from the air in the fluid cooler and the internally-produced heat which is recovered through units 46 and stored in hot water in tanks 50 is utilized to handle the heating load.

While pumps 56 and 58 are not connected to operate at all times in parallel, the flow circuits are interconnected so that the water flows along many different paths. The system of FIG. 1 operates competely under the automatic control of heat balance controller 72 which operates the valves and other components in response to changes in the heating and cooling load conditions of the various air conditioned spaces and the ambient air temperature, and in accordance with a daily time program.

Condensate from coils 132 of the air-treating units is delivered to the fluid cooler and is used for evaporative cooling of coil 18. A gravity-feed system for that purpose is represented by the dotted lines 140.

The following are illustrative modes of operation of the system of FIG. 1:

1. Various embodiments of the present invention incorporate certain concepts of U.S. Pat. No. 3,738,899 and involving the utilization of water storage tanks. The water acts as (a) a heat source under high heat load conditions, and (b) as a source of supplementary stored chilled water under high cooling-load conditions. The tanks contribute substantially to the high efficiency of the illustrative systems from the standpoint of conservation of energy. The tanks also broaden the scopes of the heating and cooling loads which the illustrative system can handle.

2. For peak cooling load conditions without use of the tanks, the return water from line 64 is added to the cooled water from the fluid cooler in line 68, and the hot water from the condenser circuit flows to the fluid cooler.

3. For Summer night operation, particularly when high cooling load conditions are anticipated on the following day, the water in tanks 50 is cooled by recirculating it through the evaporator chillers and through line 52 to the tanks and hot water passes from line 40 through the fluid cooler, line 68, valve 61 and line 59 to pump 58. During night operation the condenser heat is dissipated through the fluid cooler using outside air. The stored chilled water then aids in handling the cooling load during the following day.

4. For peak heating load conditions with or without the use of the tanks, the chilled water flows from line 42 through valve 88 to the fluid cooler in which the water is heated by the exhaust air, (or by water when the fluid cooler uses water as the heat-sink or heat source), and it returns through line 68 to the evaporator circuit, or to the evaporator circuit through the tanks. The chiller water which has been heated in coil 18 and then returned, is cooled again in the evaporator-chiller circuit, or passed to the tank circuit. The heat taken on by the water in coil 18 is delivered to the water in the condenser circuit and flows through line 40 to the air-treating units, as the return water passes to the condenser circuit or to the water-heating circuit.

Also, when tanks 50 contain hot water, and particularly systems using 100% outside air or at peak heating loads, some chilled water is passed through line 42 and valve 88 to coil 18 of the fluid cooler and then through valve 61 and line 59 to pump 58 and through the evaporator-chillers. The return chilled water recirculated through tanks 50 displaces the warmer water falling from the tanks. The warm water from the fluid cooler and from the tanks false loads the evaporator-chillers and delivers the additional heat to the hot water which flows through the water-heating circuit.

5. For heating below the break-even temperature (which is the outside air temperature at which the overall or net heat loss from the system is equal to the heat produced within the system), heat is extracted from the exhaust air by the fluid cooler. For that operation, chilled water flows from line 42 through valve 88 to the fluid cooler and thence through line 68, valve 61 and line 59 to pump 58 and through the evaporator-chillers.

6. During a Winter building "shut down" period, hot water in tanks 50 can be used as a heat source by recirculating water from the tanks through the water-cooling circuit to "false load" the condensers.

The system of FIG. 2 differs from that of FIG. 1, only as pointed out and as is obvious from the construction disclosed. There is a third liquid distribution line 41 for neutral water which is at a temperature between those of the hot water and the cold water. Line 41 extends to the valves supplying water to the various air-treating units and is connected elsewhere as shown in the drawing. The components of the system of FIG. 2 which are identical with those of FIG. 1 are given the same reference numbers. When desirable, return line 60 is connected through a valve 148 to line 64 and through a valve 101 and a line 102 to pump 56, and from valve 101 through a line 103 to pump 58. Hence, the return water from any of units 44 and 46 can be delivered to either of the pumps. A common discharge line 104 is connected to the outlet sides of both of the pumps, and neutral line 41 extends from line 104 so that line 41 can receive water from either of the pumps. Line 103 is also connected to the discharge line 54 from the storage tank circuit, and neutral line 41 is connected through a valve 105 to supply line 52 to the tank circuit, so that the tank circuit can receive hot water or cold water or neutral water, but discharges only through pump 58. However, water from either pump can be discharged through the evaporator-chiller to line 42, or to neutral line 41, or through the condenser circuit to hot water line 40. The water picks up heat in the fluid cooler and "false loads" the refrigerator system, that is, the refrigeration system acts to transfer heat within the system. The "preferential flow pattern" for the water is from pump 58 through the chiller circuit to line 42, and from pump 56 through the condenser circuit to line 40, and secondly only from each pump to neutral line 41. The flow patters from the pumps result directly from the flow through the various air-treating units 44 and 46. That is, when greater amounts of either hot or cold water are used, there is a drop in the back pressure in the respective line 40 or 42, and less water flows from the respective pump to another path. At each of the air-treating units there are two variable mixing valves, valve 106 which is operative to supply controlled amounts of cold water and neutral water to the unit, and valve 107 which is operative to supply controlled amounts of hot water and neutral water to the unit. Hence, each unit is supplied with either hot water or cold water alone or a mixture of one of those with the neutral water, to thereby control the temperature of the air being discharged from the unit. A modulating valve 109 connects neutral water line 51 and cold water line 42 to a line 110 which is connected through a modulating valve 111 to coil 18 of the fluid cooler, so that either cold water or neutral water or a mixture of the two can be supplied to coil 18. Valve 111 is also connected to hot water line 40 so that hot water or a mixture of hot water and neutral water from line 110 can be supplied to coil 18. However, the invention does not contemplate mixing hot and cold water at valve 111, and neutral water is supplied to line 110 if any water is mixed with the hot water by valve 111. A line 164 and a valve 148 direct water from unit 44 to line 64 or to line 60.

The system of FIG. 2 is also provided with an air-preheater system for air-treating units 46. A glycol solution or other anti-freeze liquid is supplied to a heat-exchange coil 130 which is positioned between fan 131 and a heat-exchange coil 132 so as to pre-heat the air flowing into coil 132. A glycol solution is heated in a heat-exchanger 135 and is supplied to coil 130 from the heat-exchanger through a line 129, a pump 134 and a line 133. A line 136 from coil 130 to the heat-exchanger provides for the return flow. Heat-exchanger 135 receives hot water from line 40 which is discharged to line 60 after passing in heat-exchange relationship with the stream of glycol solution.

An additional means for heating the glycol solution is provided by a coil 141 in the fluid cooler positioned in the path of the exhaust air. The exhaust air will have given up a substantial amount of heat in passing through coil 18, but normally will be at a temperature substantially above that of the outside air being supplied to units 46. A pair of lines 143 and 139 extend from coil 141 respectively to line 136 and to a valve 137 in line 129. Valve 137 is operative to divert all or part of the stream of the glycol solution flowing to pump 134 from line 136 and heat-exchanger 135 to line 139 so that the glycol solution is heated in coil 141 is delivered to pump 134 and flows through line 133 to coil 130. When sub-freezing temperature air is being supplied to units 46, the glycol solution will be at a sufficiently high temperature to pre-heat the air entering unit 46.

The following are illustrative modes of operation of the system of FIG. 2:

1. At peak cooling during the daytime with 20% outside air, for example, and without use of the water in the storage tanks, the chiller water temperature is reduced from 72° F., to 40° F., and the temperature of the hot water is increased from 77° F. to 115° F. The water flowing through the fluid cooler is cooled from 115° F. to 72° F. The outside air enters at 95° F., and air is delivered to the air-conditioned spaces at 55° F., and returns to units 46 at 78° F.

2. At peak cooling loads during the daytime and with 100% outside air, and with the water in tanks 50 having been pre-cooled during the night, all of the hot water passes to the fluid cooler and flows with some water from tanks 50 to the evaporator-chiller circuit. The amount of water from the tanks is that required to satisfy pump 58 (when added to the water from the fluid cooler), and the same amount flows from neutral line 40 to the tanks. Illustratively, chilled water flows from tanks 50 at 40° or higher and is mixed with return water, and flows through neutral line 41 or through the chiller circuit and line 40 to units 44 and 46.

3. At peak heating loads, the water in tanks 50 may be used to supply supplemental heat, and heat can be recovered by cooling the exhaust air. For that operation, pump 58 receives hot stored water from tanks 50 and return water from the air treating units through line 60 and 64, and the chiller water flows to the fluid cooler which is supplied with exhaust air only. Pump 56 directs water through the condenser circuit. The neutral water can flow from either of the pumps.

4. When one or more of the air treating units requires heating while other air treating units require cooling, neutral water is supplied to the units requiring heating as long as the neutral water will supply the desired heating.

In each of FIGS. 1 and 2, the entire water circulating system is interconnected to the extent necessary to provide continuous flow from the two pumps. In FIG. 2, the flow is through the hot, cold and neutral water lines to the various air treating units, whereas, in FIG. 1, there are various hot water and cold water circuits which are separate. The paths of flow are created by controller 72 which controls the temperature of the hot water and the quantity and temperature of the water flowing to the fluid cooler, and to deliver heat to or carry heat from the air treating units, and to carry heat to and recover heat from the fluid cooler and the tank circuit. With a cooling load, with the water passing through coils 132 counterflow to the air, the air picks up the fan heat and transfers it to the water leaving the coil without materially reducing the air-cooling effect of the coils. The water passes to pump 56 and also picks up the pump heat, and flows to the condenser circuit, so that all of the fan and pump heat is carried to fluid cooler 20. With a heating load the fan heat gives an air-preheating effect, and the pump heat is added to the hot water. Hence, the fan and pump heat is carried to the fluid cooler at outside temperatures above the break-even temperature, and to the air-treating units at outside air temperatures below the break-even temperature. The illustrative systems include a "fluid cooler", which is an evaporative cooling tower, but it is also a heat source. However, it may be a water heat-exchanger wherein the well-water or water from another source is a heat-sink and heat source.

In the illustrative embodiments, the fluid cooler utilizes the condensate and the exhaust air to provide the heat-sink means, and utilizes the exhaust air as a heat source during operation below the break-even temperature. It is understood that a stream of water from a well or another source can be the heat-sink and a heat source, with a liquid-to-liquid heat-exchanger being the "fluid cooler". With either type of fluid cooler, the fluid, either air or well-water, being discharged from the system is a potential heat source below the break-even temperature, and is a potential heat-sink above the break-even temperature.

This invention contemplates the necessary use of a minimum amount of outside air with substantially the same amount being exhausted through the fluid cooler and thereby raising the wet bulb temperature of the exhaust air to a level higher than is the usual practice. That is made possible by the higher temperature condensing water leaving the staged condenser circuit before entering the fluid cooler, thus allowing the available quantity of exhaust air to pick up much more heat than in the systems of the previous patents mentioned above.

Where the system requires more outside air than required for normal human-comfort applications, such as hospitals, laboratories, restaurants, etc., advantage can be taken of the greater resulting amount of exhaust air to thereby reduce the number of stages in the staged water cooler system. That is because the greater quantity of exhaust air available will permit the dissipation of the generated condenser heat with a lower wet bulb temperature leaving the fluid cooler.

The minimum quantity of dehumidified outside air to satisfy the exhaust air requirement for the fluid cooler will be about 0.11 cubic foot per minute per square foot of air conditioned space. However, the use of greater quantities of outside air, when available, and even when not necessary for adequate ventilation requirements, can sometimes be justified to reduce the overall consumption of compressor energy. That is true particularly when greater quantities of outside air are provided at outside wet bulb temperatures below peak design conditions.

In many cases the condensate may be more than enough to supply the make up water for the fluid cooler especially when 0.2 cubic feet per minute of outside air per square foot of conditioned space is introduced through air-treating units 46. When additional water is required to maintain a satisfactory level in the fluid cooler pan, an automatic inlet valve controlled by a float in the pan will admit additional water.

A drain valve in the pan set at a higher level in the pan will permit water to overflow when excess water is supplied. By increasing those two levels, excess condensate water can be accumulated to handle the evaporative cooling when the water in storage tanks 50 is being cooled and there is no air cooling so that no condensate is being generated.

In FIGS. 1 and 2, the condensate flows by gravity to the fluid cooler. When the fluid cooler is at a level above that of the air-treating units, the condensate is collected in a sump tank, and is pumped to the fluid cooler, with there being a float control to start the pump at a maximum condensate level in the sump tank and to stop it at a minimum level.

The systems of FIGS. 1 and 2 have fresh water supply means (not shown) which are operative to add water to the fluid cooler when the water level in the sump is below an acceptable level. However, it is contemplated that the condensate will be sufficient in many installations to make it unnecessary to add additional water except under emergency conditions. A drain valve (not shown) in the sump permits condensate to overflow when the amount of condensate is greater than that evaporated in the fluid cooler.

While removing condenser heat, the water leaving the fluid cooler approaches the wet-bulb temperature of the entering air. A practical design is to provide a difference between those temperatures of the order of ten degrees F. so that 62° room air-exhaust temperature will produce 72° return water leaving the fluid cooler. For example, at peak cooling load conditions of 95° outside temperature, the return water from the air-treating units, after picking up the fan heat from the fan located ahead of the unit coils as shown in FIG. 1, will be between 74° and 84° depending upon the percentage of outside air used. The fan heat will raise the percentage of outside air used. The fan heat will raise the return water temperature from two to four degrees F. Normally, the refrigeration load required would be in relation to the temperature of the water entering the first water cooler (evaporator-chiller) minus the temperature of the water leaving the last water cooler, for example 74° to 84° entering (depending upon the percent of outside air) and the leaving temperature, for example, 40°. By comparison, with the water leaving the fluid cooler at 72°, the refrigeration load is reduced in the ratio of the order of $$\frac{72-40}{74-40} \text{ to } \frac{72-40}{84-40}$$

depending upon the percent of outside air used.

In effect, this invention permits the use of the heat pump principle to raise the temperature of the hot water from the condenser circuit by staging the flow of the water through the evaporator-chillers counter to the flow through the condensers of the respective refrigeration units. It is noted this higher condensing water temperature is obtained without increasing the compressor horsepower as would be the case for equal condensing water temperatures using single stage compressor systems.

It is also noted that greater quantities of outside air are possible without the penalty of higher operating expense as would be the case with present conventional systems. This is particularly important in multi-story office buildings because of stack effect. For example, with low volume of outside air such as 0.1 cubic foot of air per minute per square foot of air conditioned space, the stack effect can cause infiltration of outside air through doors particularly at the lower level floors of low outside air temperatures. Severe heating problems have occurred at low outside air temperatures and the higher hot water temperatures made possible by the present invention overcome those problems.

Each of the systems of FIGS. 1 and 2 is operative to extract heat from the fluid cooler and store the heat in the tanks when that is desirable. In FIG. 1, pump 58 receives water from coil 18 through line 68, valve 61 and line 59 and directs it through the evaporator chiller circuit and thence through line 42 and valve 88 to coil 18. Pump 56 withdraws water from the tanks through line 54, valve 63 and line 60, and directs the water through the condenser circuit, and thence through line 40, valve 71 and line 52 back to the tanks. The heat extracted from coil 18 is delivered with the pump heat to the water in the tanks. In the systems of FIGS. 1 and 2, heat can be extracted from the fluid-to-fluid heat exchanger when well water or other external-source water is the fluid which acts as the heat source and heat-sink. With the system of FIG. 2, water from the common pumping head of pumps 56 and 58 flows through the evaporator chiller circuit, line 42, valve 88 and coil 18 where it picks up heat. Water also flows from the tanks through line 54, valve 101 and line 102 to pump 56, and flows by preference through the condenser circuit and thence through line 40, valve 71 and line 52 to the tank circuit. The heat which is extracted from the external-source water is therefore transferred to the water flowing back to the tank circuit. The specific system of FIG. 1 has limited use with the cooling tower shown, since chilled water is limited to about 40° F. This limits heat removal from the fluid cooler using outside air at and above about 50° F. With 50° F. outside air temperature there is little need for internal heating. When external water is used the winter temperature of the external water can be at a temperature of 55° F., so that heat can be extracted, illustratively cooling the external water to 45° F. Therefore, well water, for example, can be a source of external heat at times when the outside temperature is too low for external air to be the source of heat.

The provision of a neutral water line in the system of FIG. 2 gives very substantial advantages over the now conventional "three pipe" systems of U.S. Pat. No. 2,796,740 where hot and cold water lines and a return line extend to each air-treating unit. With those systems, hot and cold water are available at each such unit and are mixed when necessary to provide water of the desired temperature for the unit while maintaining a uniform rate of water flow through the units. That was a very substantial improvement over the prior four pipe systems. However, the use of neutral water to mix with either hot or cold water gives greatly improved utilization of energy. The neutral water is subjected to no heating or cooling and the only energy consumed is that required to circulate it, and it provides precise control of the air temperature.

The present invention is applicable to systems of the types of the illustrative embodiments which have wide ranges of capabilities. Also, when the system has neutral water lines (FIG. 2), substantial savings in energy will be effected, for example, under low-load conditions, when one or more of the air-treating units is operating to heat the air while one or more of the other air-treating units is operating to cool the air. When that system is operating in that manner, heat-balance controller 72 supplies neutral water to the air-treating unit which require heating whenever the temperature of the neutral water is high enough to handle the heating load. The neutral water supplies the desired amount of heat in the air-treating units which require heat, and those units act as heat-sinks for that heat. That effects a corresponding reduction in the cooling load, thus reducing the energy consumption by the compressors. It also reduces the temperature of the water passing to the fluid cooler, and that reduction in the amount of heat which must be discharged increases the efficiency of the heat transfer of the entire refrigeration system.

The respective terms "fan heat" and "pump heat" mean the heat produced within the system by the operation of the fans or blowers and by the water pumps. The total of all of that heat in any central air conditioning system for a large building is not less than five percent of the total cooling load for the entire system, and may be several times that percentage. The present invention provides for transferring all of the fan heat to the water at the downstream sides of the air-treating units so that that heat is carried back to the refrigeration system by the return water without materially affecting the cooling of the air streams. The pump heat is also transferred to the return water before the water passes to the refrigeration system. Hence, all of that heat is discharged in an efficient manner through the fluid cooler under cooling-load conditions, and it is available below the breakeven outside temperature to aid in handling the heating load. The system can also recover heat from the exhaust air and from outside air when energy conservation considerations make that desirable.

The fluid cooler of the illustrative embodiments is an evaporative cooling tower. When the fluid cooler is a stream of outside water from a well or another source, the invention also contemplates the use of a tower in which exhaust air is passed in heat-exchange relationship with a stream of the hot water or cold water of the system, in accordance with modes of operation discussed above.

It should be noted that the single heat transfer coils of air-treating units 44 and 46 are used for both heating and cooling. That is particularly advantageous with "four pipe" systems such as in the embodiments of FIG. 1. That provides for efficient heat transfer at all times so that the desired wide ranges of temperature changes can be insured.

The invention provides improved control over the quantities of heat stored in or supplied to or discharged from the system, so as to control and change those as required. The storage tanks receive hot water or cold water (or neutral water in FIG. 2), and that permits wide ranges of modes of operating depending upon the existing and anticipated heating and cooling loads.

The illustrative embodiments of the present invention are of the "Envelope System" type (see U.S. Pat. Nos. 3,670,806 and 3,842,901) in which there are false ceilings in the interior space and the return air carries away the heat from the ceiling lights. The term "hot water" and "cold water" are used herein to mean the streams which have passed along the water-heating circuit and the water-cooling circuits, respectfully. The temperatures of those streams of water varies depending upon conditions of operation.

It is understood that modifications can be made in the illustrative embodiments of the invention and that the various aspects thereof can be used separately or together all within the scope of the claims. Each system must be designed and engineered to meet the particular requirements for the system to provide efficient operation at an acceptable initial cost. To that end, the various concepts of the present invention provide choices in the basic design features so as to provide energyefficient systems which meet a wide range of different basic requirements.

I claim:

1. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source.

2. An air conditioning system as described in claim 1 which includes means to pass a stream of fresh air in heat-exchange relationship with a liquid and thence to one or more of said air-treating units, and means to supply said liquid to said heat-exchange means in heat-exchange relationship with air being discharged from the conditioned space to thereby extract heat from said air being discharged and to deliver said heat to said stream of fresh air.

3. An air conditioning system as described in claim 1 which includes heat-exchange means and the means to pass said stream of fresh air and a stream of said heated liquid in heat-exchange relationship with each other.

4. An air conditioning system as described in claim 1 wherein said water pumping and circulating system comprises water supply lines extending to said air-treating units for said cooled water and said heated water and for neutral water which has not been heated or cooled after being returned from said air-treating units, and valve means to change the flow paths and thereby modulate the temperature of either said cooled water or said heated water being delivered to one or more of said units.

5. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water storage tank means in which excess heat is stored by increasing the temperature of the water in said tank means at such times as the condensing water temperature rises above that temperature needed instantaneously to handle the current cooling load, and wherein heat balance controller means directs said stream of heated water into said storage tank means in the amount which is in excess of that required instantaneously to produce said stream of heated water to satisfy the instantaneous heat requirements and thereby increase the amount of heat stored in said tank means in anticipation of a period when the amount of heat required is less than the heat which is generated by the system.

6. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water storage tank means in which excess heat is stored by increasing the temperature of the water in said tank means at such times as the condensing water temperature rises above that temperature needed instantaneously to handle the current cooling load, and wherein heat balance controller means directs said stream of heated water into said storage tank means in the amount which is in excess of that required instantaneously to produce said stream of heated water to satisfy the instantaneous heat requirements and thereby increase the amount of heat stored in said tank means in anticipation of a period when the amount of heat required is less than the heat which is generated by the system, and operating the system to include the steps of, during normal or peak heating load operation, measuring the temperature of the stored tank water and when a preset temperature is reached shutting off the delivery of hot water to said tank system and discharging the condensing water heat in excess of that required for instantaneous building-heating requirements to the fluid cooler which will then resume its normal function as a heat sink.

7. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air-conditioning system includes water-storage tank means whereby excess heat can be stored at such times as the condensing water temperature tends to rise above that temperature instantaneously called for by a heat balance controller and which includes water storage tank means and which is regulated in accordance with the outside temperature, and wherein said heat balance controller directs a stream of said heated water into said water-storage tank means in the amount which is in excess of that required instantaneously to produce said stream of heated water to satisfy the instantaneous heat requirements, thereby to increase the amount of heat stored in said tank means in anticipation of a period when the amount of heat required instantaneously is less than the heat which is being generated by the system.

8. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water-storage tank means whereby excess heat can be stored at such times as the condensing water temperature tends to rise above that temperature instantaneously called for by a heat balance controller and which includes water storage tank means and which is regulated in accordance with the outside temperature, and wherein said heat balance controller directs a stream of said heated water into said water-storage tank means in the amount which is in excess of that required instantaneously to produce said stream of heated water to satisfy the instantaneous heat requirements, thereby to increase the amount of heat stored in said tank means in anticipation of a period when the amount of heat required instantaneously is less than the heat which is being generated by the system, and including the steps of, measuring the temperature of the water stored in said tank means, and when a preset temperature is reached shutting off the delivery of heated water to said tank means and directing the condensing water in excess of that required for instantaneous building-heating requirements to said fluid cooler which will then resume its normal function as a heat sink.

9. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature and whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water storage tank means in which excess heat is stored by increasing the temperature of the water in said tank means at such times as the condensing water temperature rises above that temperature needed instantaneously to handle the current cooling load, and wherein heat balance controller means directs said stream of heated water into said storage tank means in the amount which is in excess of that required instantaneously to produce said stream of heated water to satisfy the instantaneous heat requirements and thereby increase the amount of heat stored in said tank means in anticipation of a period when the amount of heat required is less than the heat which is generated by the system, and wherein said controller means prevents boiler or other supplementary heat from being introduced except when the water temperature in said tank means has been reduced to a set point.

10. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water storage tank means in which excess heat is stored by increasing the temperature of the water in said tank means at such times as the condensing water temperature rises above that temperature needed instantaneously to handle the current cooling load, and wherein heat balance controller means directs said stream of heated water into said storage tank means in the amount which is in excess of that required instantaneously to produce said stream of heated water to satisfy the instantaneous heat requirements and thereby increase the amount of heat stored in said tank means in anticipation of a period when the amount of heat required is less than the heat which is generated by the system, and wherein said controller means can be set to direct excess cooled water directly to said tank means.

11. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water storage tank means in which excess heat is stored by increasing the temperature of the water in said tank means at such times as the condensing water temperature rises above that temperature needed instantaneously to handle the current cooling load, and wherein heat balance controller means directs said stream of heated water into said storage tank means in the amount which is in excess of that required instantaneously to produce said stream of heated water to satisfy the instantaneous heat requirements and thereby increase the amount of heat stored in said tank means in anticipation of a period when the amount of heat required is less than the heat which is generated by the system, and wherein said controller means can be set to direct excess cooled water directly to said tank means, and wherein said controller means includes an override means for certain time periods.

12. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water storage tank means in which excess heat is stored by increasing the temperature of the water in said tank means at such times as the condensing water temperature rises above that temperature needed instantaneously to handle the current cooling load, and wherein heat balance controller means directs said stream of heated water into said storage tank means in the amount which is in excess of that required instantaneously to produce said stream of heated water to satisfy the instantaneous heat requirements and thereby increase the amount of heat stored in said tank means in anticipation of a period when the amount of heat required is less than the heat which is generated by the system, and wherein said controller means can be set to direct excess cooled water directly to said tank means, and wherein for certain periods of peak capacity or peak system demand the water cooling load can be reduced or eliminated entirely and the cooling supplied by the cold tank water in said tank means.

13. An air conditioning system which includes, refrigeration means which is operative to produce a stream of cooled water and a stream of heated water, a plurality of air-treating units each of which is operative to pass air in heat exchange relationship with water from one side of said streams to thereby heat or cool air and to then deliver the air to an air conditioned space, a continuous water pumping and circulating system which circulates streams of water throughout the air conditoning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water storage tank means in which excess heat is stored by increasing the temperature of the water in said tank means at such times as the condensing water temperature rises above that temperature needed instantaneously to handle the current cooling load, and wherein heat balance controller means directs said stream of heated water into said storage tank means in the amount which is in excess of that required instantaneously to produce said stream of heated water to satisfy the instantaneous heat requirements and thereby increase the amount of heat stored in said tank means in anticipation of a period when the amount of heat required is less than the heat which is generated by the system, and wherein said controller means can be set to direct excess cooled water directly to said tank means, and wherein for certain periods of peak capacity or peak system demand the water cooling load can be reduced or eliminated entirely and the cooling supplied by the cold tank water in said tank means, and wherein said over-ride means is responsive to a rise in the tank water temperature to the extent above said set point to restart said refrigeration means.

14. An air conditioning system which includes, refrigeration means which is operative to produce a stream of cooled water and a stream of heated water, a plurality of air-treating units each of which is operative to pass air in heat exchange relationship with water from one of said streams to thereby heat or cool air and to then deliver the air to an air conditioned space, a continuous water pumping and circulating system which circulates streams of water throughout the air-conditioning system, a water-to-fluid heat exchange which is adapted to pass water from one or the other of said streams of heated water or cooled water in heat-exchange relationship with a fluid which acts as a heat sink or as a heat source depending upon the relative temperatures of the water and the fluid, and control means which maintains a heat balance in the air conditioning system includes means for passing water from said stream of heated water through said water-to-fluid heat exchanger when the ambient outside temperature is above the break even temperature whereby said fluid acts as a heat sink, and passing water from said stream of cooled water through said water-to-fluid heat exchanger when the outside ambient temperature is below said break even temperature whereby said fluid acts as a heat source, and wherein said air conditioning system includes water storage tank means in which excess heat is stored by increasing the temperature of the water in said tank means at such times as the condensing water temperature rises above that temperature needed instantaneously to handle the current cooling load, and wherein heat balance controller means directs said stream of heated water into said storage tank means in the amount which is in excess of that required instantaneously to produce said stream of heated water to satisfy the instantaneous heat requirements and thereby increase the amount of heat stored in said tank means in anticipation of a period when the amount of heat required is less than the heat which is generated by the system, and wherein said controller means can be set to direct excess cooled water directly to said tank means, and wherein for certain periods of peak capacity or peak system demand the water cooling load can be reduced or eliminated entirely and the cooling supplied by the cold tank water in said tank means, and wherein said over-ride means is responsive to a rise in the tank water temperature to the extent above said set point to restart said refrigeration means, and wherein the capacity of said refrigeration means will be limited during a period of peak demand to reduce the building demand within present demand limits.

15. The air conditioning system as described in claim 1 for operation between "summer" and "winter" seasons wherein heating may be required during one part of the day and cooling during another part, as indicated by an outside temperature setting of heat balance controller means, wherein said control means directs neutral water into said tank means to be cooled by the evaporator means of the refrigeration system to false load the evaporators, thus providing sufficient heated water from the condensers to the air treating units requiring heat and cooled water or water below the return water temperature to the units requiring cooling.

16. The invention as described in any of claims 5, 6, 9, 10, 11, 12, 13 or 14 at different times of the year during different seasons, the combined means to maintain an automatic instantaneous heat balance in the building with controls and over-riding controls to limit operation and thereby in turn control or eliminate peak demand for present time periods while still maintaining an instantaneous building heat balance.

17. In a method of maintaining a heat balance condition in an air conditioning system which provides desirable conditions within a space or spaces, and which includes refrigeration means to produce a stream of heated water and a stream of cooled water and air-treating means to pass air to said space or spaces in heat-exchange relationship with said heated water or said cooled water, and wherein said system also includes a water-to-fluid heat exchanger which passes the desired amount of water from said stream of heated water into heat-exchange relationship with a fluid which constitutes a heat sink to which heat is delivered when the outside ambient temperature is above the break-even temperature, the improvement which includes the steps of, stopping the delivery of said heated water to said water-to-fluid heat-exchanger when the outside ambient temperature is below said break-even temperature, and delivering a controlled stream of cooled water from said stream of cooled water to said water-to-fluid heat-exchanger with said cooled water being maintained at a temperature below the temperature of said fluid to thereby deliver heat to said controlled stream of cooled water, and returning said controlled stream of cooled water to said refrigeration means, whereby said water-to-fluid heat exchanger acts as a source of heat for said system, and which includes the steps of, increasing the quantity of outside air to provide cooling when the system has a dominate cooling load and the outside air temperature is below the desired temperature within the air conditioned space and there is an anticipated dominate heating load condition, and passing water to said storage tanks at a temperature above the temperature of the water leaving said tanks to thereby increase the capacity of the water in said storage tanks to handle a subsequent heating load.

* * * * *